United States Patent [19]

Brown

[11] 3,955,787

[45] May 11, 1976

[54] DISPLAY STAND

[75] Inventor: George L. Brown, Benicia, Calif.

[73] Assignee: Allied Products Company, Benicia, Calif.

[22] Filed: July 10, 1975

[21] Appl. No.: 594,637

[52] U.S. Cl. ..... 248/159; 211/178 R; 248/524; 248/528; 248/175

[51] Int. Cl.[2] ..... A47F 5/10; F16M 11/38

[58] Field of Search ..... 211/177, 178; 248/48, 248/158, 159, 165, 166, 434, 435, 168, 175

[56] References Cited

UNITED STATES PATENTS

| | | | |
|---|---|---|---|
| 216,629 | 6/1879 | Powell | 248/168 X |
| 459,583 | 9/1891 | Johnson | 211/178 R |
| 1,038,198 | 9/1912 | Randall et al. | 248/165 X |
| 1,590,910 | 6/1926 | Rumrill | 248/175 X |
| 2,361,060 | 10/1944 | Robinson et al. | 248/158 |
| 2,485,081 | 10/1949 | Ahrens | 248/46 |
| 2,621,878 | 12/1952 | Kruger | 248/175 X |

*Primary Examiner*—Roy D. Frazier
*Assistant Examiner*—Lawrence J. Staab
*Attorney, Agent, or Firm*—Robert G. Slick

[57] ABSTRACT

A display stand or pole holder is provided wherein the stand is made substantially in its entirety from wire sections which are welded together. The stand can be folded to lie substantially flat so that it can be shipped in a carton of minimum size. The stand can be easily erected without the use of tools by the user.

2 Claims, 5 Drawing Figures

DISPLAY STAND

SUMMARY OF THE INVENTION

It is frequently desirable to provide a pole holder for various purposes and particularly for use in advertising display stands. Since such holders are ordinarily provided without charge to merchants and are distributed in large numbers, it is important that the holders be relatively inexpensive. It is further important that the holder be of such a nature that it can be shipped in a minimum amount of space and easily erected without the use of tools by unskilled employees.

Since such stands frequently must carry a considerable amount of weight and resist the onslaught of the public, they must be of rugged construction.

The stand of the present invention meets all of these requirements. It is easily fabricated from wire sections utilizing simple bending and welding techniques. It is extremely rugged and folds flat for shipment.

It is extremely strong so that it is capable of holding large displays including display baskets, and is not easily tipped over.

Various other features and advantages of the invention will be brought out in the balance of the specification.

DESCRIPTION OF THE PREFERRED EMBODIMENTS

Figure 1:
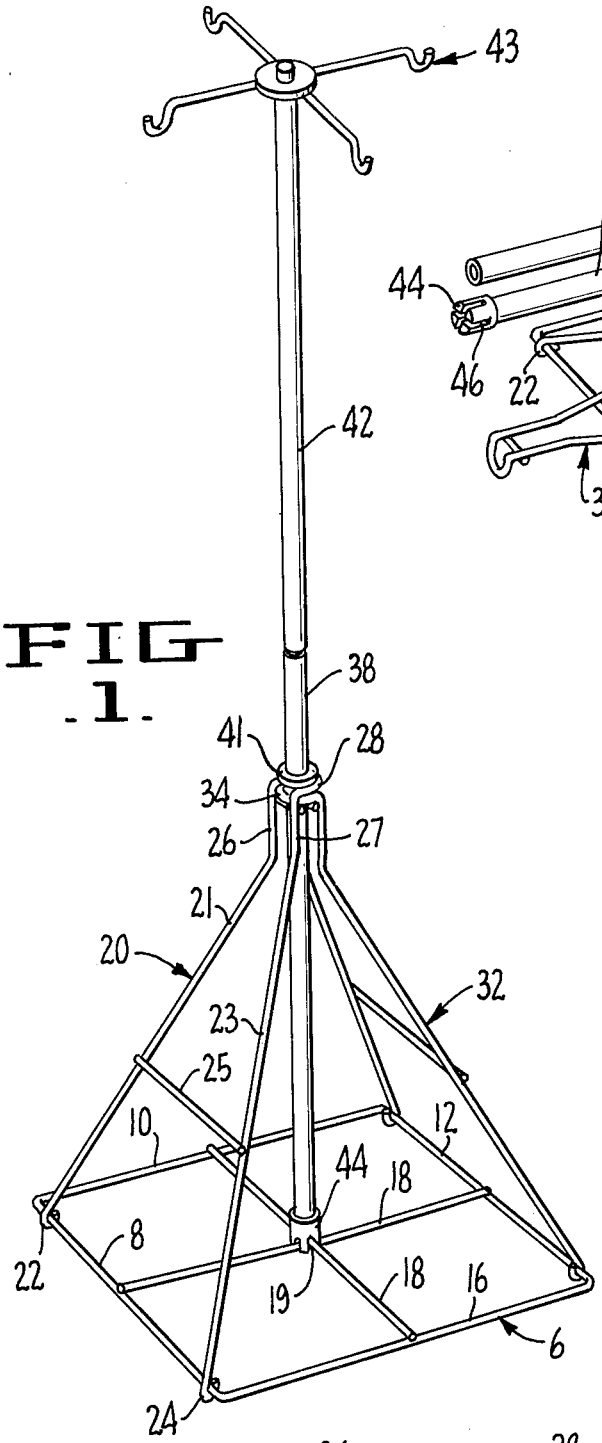
FIG. 1 is a perspective view of a stand embodying the present invention showing its use to support display hooks.

Referring now to the drawings by reference characters, the stand includes a rectangular base member generally designated 6 having four sides 8, 10, 12 and 16, all of which can be formed from a single heavy piece of wire, bent and welded together. A cross member 18 is provided which is fastened to the centers of the four sides of the base as shown, forming cross 19 at the center of the base 6. All of these joints are preferably fashioned by welding the parts together.

Two pole supporting members, generally designated 20 and 32, are hinged to the base 6 and serve to support the pole. Since these two members are so similar, only one will be described in detail. Each of the members 20 and 32 is formed of a single piece of wire with the exception of a small member welded near the top. The member 20 has uprights 21 and 23, the terminal ends of which are bent over the base member 8 to form the hinge connections 22 and 24. A cross member 25 can be employed to brace the members. Near the upper portion there are short vertical sections, that portion of 21 being designated 26 and the vertical portion of 23 being designated 27. The two parts come together in a horizontal portion 28 in the form of a curve having a diameter which will admit the pole to be used without any substantial play. Welded to the vertical sectin 26 and 27 and just below the horizontal portion 28 is a horizontal member 30 which is spaced from 28 by substantially the diameter of the wire employed to formulate the members for reasons which will be soon apparent. The opposite member 32 similarly terminates in a loop 34 and has a horizontal member 36 in the same relationship as the horizontal member 30 previously described.

The upright portion of the stand consists of one or more pole sections such as that designated 38 which has a reduced end portion 40 which telescopes to a mating section 42. These members can suitably be formed of metal tubes. Washer 41 fixed to pole 38 prevents any tendency of the top of the wire base from riding up the pole. Obviously, any number of pole sections may be employed in the finished stand. At the bottom of the member 38 is an enlarged portion 44 suitably made of plastic, which slips over the rod 30 and which has crossed slots 36, said slots being of a size to form a snug fit with the cross members 18 at the bottom of the base.

Figure 2:
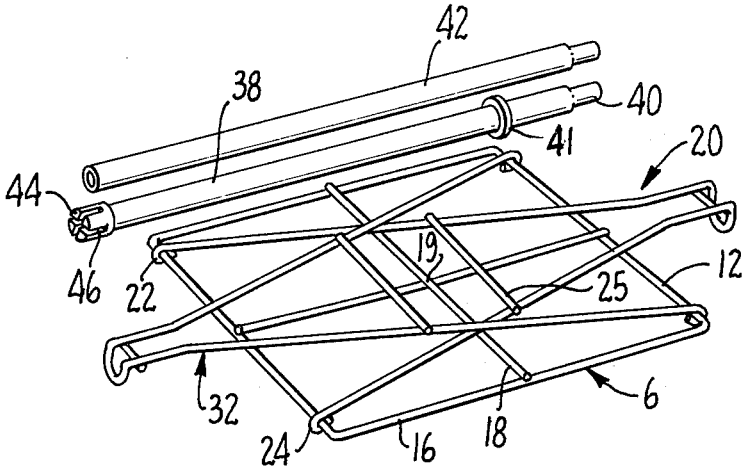
FIG. 2 is a perspective view of the stand shown in FIG. 1 with the parts in a folded condition.
Figure 4:
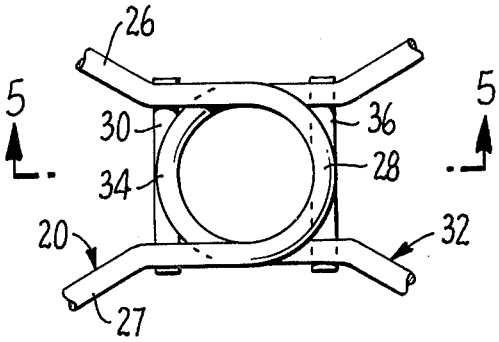
FIG. 4 is a plan view of the structure shown in FIG. 3.
Figure 5:
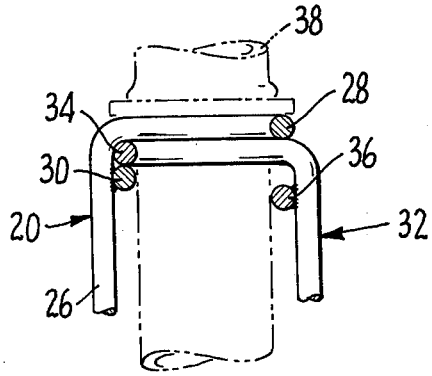
FIG. 5 is a section on the line 5—5 of FIG. 4.
Figure 3:
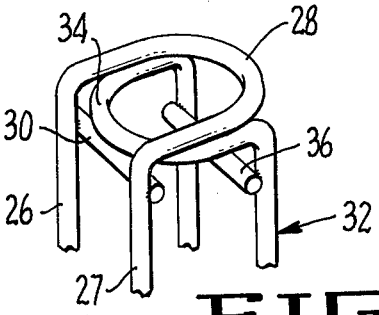
FIG. 3 is an enlarged partial perspective of the top structure of the display stand.

The stand of the present invention would be normally shipped flat, i.e. in the configuration shown in FIG. 2. In order to erect the stand, the arms 20 and 32 are first raised upwardly and then the curved portion 32 is pushed between the uprights formed by the portion 28 and the cross member 30. The upright 38 is then placed downwardly through the opening formed by the loops 28 and 34 and the cross member 44 is hooked onto the center of the cross members 18. Additional sections such as section 42 can then be used to form a pole of any desired height and one can use the stand to hold any kind of a device such as display hooks 43.

Although a specific embodiment has been described, many variations can be made in the exact structure shown without departing from the spirit of this invention.

I claim:

1. A pole holder or the like which is adapted to be shipped in collapsed form and easily erected comprising in combination:

a. a square base member formed of heavy wire, b. a cross member consisting of two wires connecting substantially the center portions of each of the opposite sides of said square member and forming a right angle crossing at the center of the base member, c. triangular members hingedly connected at their terminal ends to two of the opposite side members of said base member, d. each of triangular members being formed of a stiff wire and having a curved interlocking horizontal center section, e. spaced cross members located under said curved interlocking sections separated therefrom by a space about equal to the diameter of the wire used to form said triangular members, and f. a central pole member passing between said curved interlocking sections and having a cross-grooved member at the bottom terminal end thereof, said grooved member snapping over said right angle crossing.

2. The structure of claim 1 wherein the cross-grooved member consists of a plastic cap on said central pole member.

* * * * *